US005844525A

United States Patent [19]

Hayes et al.

[11] Patent Number: 5,844,525

[45] Date of Patent: Dec. 1, 1998

[54] PRINTED MONOPOLE ANTENNA

[76] Inventors: Gerard James Hayes, 207 Abercrombie Rd., Wake Forest, N.C. 27587; Ross Warren Lampe, 2408 White Oak Rd., Raleigh, N.C. 27609

[21] Appl. No.: 858,407

[22] Filed: May 19, 1997

Related U.S. Application Data

[63] Continuation of Ser. No. 459,237, Jun. 2, 1995, abandoned.

[51] Int. Cl.[6] ..... H01Q 1/24

[52] U.S. Cl. ..... 343/702; 343/846

[58] Field of Search ..... 343/700 MS, 702, 343/749, 818, 895, 846, 848; H01Q 1/24, 1/38

[56] References Cited

U.S. PATENT DOCUMENTS

| | | | |
|---|---|---|---|
| 3,231,894 | 1/1966 | Nagai . | |
| 4,138,681 | 2/1979 | Davidson et al. | 343/702 |
| 4,370,657 | 1/1983 | Kaloi | 343/700 |
| 4,381,566 | 4/1983 | Kane | 455/193 |
| 4,644,366 | 2/1987 | Scholz | 343/895 |
| 4,725,395 | 2/1988 | Gasparaitis | 264/250 |
| 4,829,591 | 5/1989 | Hashimoto et al. | 455/89 |
| 4,849,765 | 7/1989 | Marko | 343/702 |
| 4,860,020 | 8/1989 | Wong et al. | 343/834 |
| 4,916,417 | 4/1990 | Ishikawa et al. | 333/204 |
| 5,008,681 | 4/1991 | Cavallara et al. | 343/700 |
| 5,061,944 | 10/1991 | Powers et al. | 343/795 |
| 5,124,733 | 6/1992 | Haneishi | 343/700 |
| 5,231,412 | 7/1993 | Eberhardt et al. | 343/790 |
| 5,270,722 | 12/1993 | Delestre | 343/700 |
| 5,313,216 | 5/1994 | Wang et al. | 343/700 MS |
| 5,363,114 | 11/1994 | Shoemaker | 343/713 |
| 5,382,959 | 1/1995 | Pett et al. | 343/700 |
| 5,389,917 | 2/1995 | Kaloi | 343/700 MS |
| 5,406,295 | 4/1995 | Baranski et al. | 343/713 |
| 5,463,406 | 10/1995 | Vannatta et al. | 343/702 |
| 5,489,914 | 2/1996 | Breed | 343/818 |

FOREIGN PATENT DOCUMENTS

| | | | |
|---|---|---|---|
| 0590534 | 4/1994 | European Pat. Off. | H01Q 1/24 |
| 0616383 | 9/1994 | European Pat. Off. | H01Q 1/27 |
| 0642189 | 3/1995 | European Pat. Off. | H01Q 1/24 |
| 0649181 | 4/1995 | European Pat. Off. | H01Q 1/36 |
| 3129045 | 10/1982 | Germany | H01Q 21/06 |
| 4324480 | 1/1995 | Germany . | |
| 5382246 | 7/1978 | Japan . | |
| 2229321 | 9/1990 | United Kingdom | H01Q 1/50 |
| 9105374 | 4/1991 | WIPO | H01Q 9/40 |
| 9312559 | 6/1993 | WIPO | H01Q 9/42 |
| 9428595 | 12/1994 | WIPO | H01Q 19/09 |

OTHER PUBLICATIONS

Patent Abstracts of Japan, vol. 14, No. 308, Yutaka, et al., Jul. 1990 JP2098202.

IEEE Transactions on Antennas and propagation, vol. AP–32, No. 4, XP002011484, Nakano, et al., "*Shortening Ratios of Modified Dipole Antennas*," Apr. 1984.

Electronic Letter vol. 30, n. 21, dated Oct. 13, 1994, Stevenage GB, pp. 1725–1726, XP002011407 Lebbar et al., "*Analysis and Size Reduction of Various Printed Monopoles with Different Shapes*".

(List continued on next page.)

*Primary Examiner*—Donald T. Hajec
*Assistant Examiner*—Tan Ho
*Attorney, Agent, or Firm*—James P. Davidson

[57] ABSTRACT

A printed monopole antenna is disclosed having a printed circuit board with a first side and a second side, a monopole radiating element comprising a first conductive trace formed on the printed circuit board first side, and a conductive element comprising a second conductive trace formed on the printed circuit board adjacent the first conductive trace. The second conductive trace defines an extended ground plane which prevents the radiation of currents from that portion of the first conductive trace aligned with the second conductive trace. The second conductive trace may be formed on either side of the printed circuit board. The printed monopole antenna may be modified to operate within two separate frequency bandwidths.

24 Claims, 3 Drawing Sheets

OTHER PUBLICATIONS

Motorola Technical Developments, vol. 6, No. 1 dated Oct. 1986, Schaumburg, Illinois, U.S., pp. 24–25, XP002011408 Hibgy et al., "*High Frequency Whip Antenna* (*800 MHz*)".

Conference Proceedings RF Expo West 1995 EMC/ESD International, dated Jan. 29, 1995–Feb. 1, 1995 San Diego, CA, pp. 117–124, X00049812 Breed, "*Multi–Frequency Antennas for Wireless Applications*".

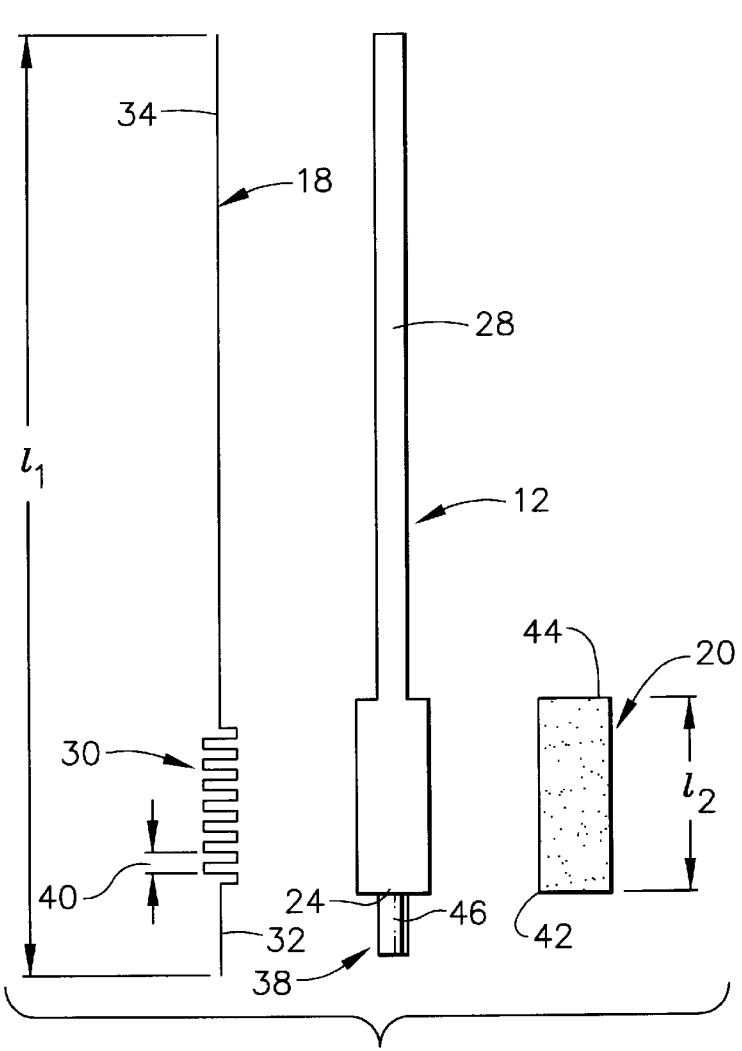
FIG. 1
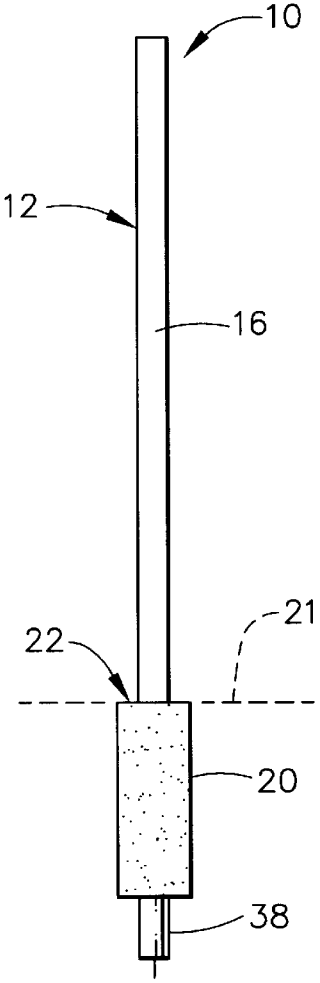
FIG. 2
FIG. 3

PRINTED MONOPOLE ANTENNA

This application is a continuation of application Ser. No. 08/459.237, filed Jun. 2, 1995, now abandoned.

BACKGROUND OF THE INVENTION

1. Field of the Invention

The present invention relates to monopole antennas for radiating and receiving electromagnetic signals and, more particularly, to a printed monopole antenna including a conductive element which defines an extended ground plane to prevent the radiation of currents from a portion of the printed monopole radiating element.

2. Description of Related Art

With respect to portable radios, cellular telephones, and other communication equipment, it has been found that a monopole antenna mounted perpendicularly to a conducting surface provides an antenna having good radiation characteristics, desirable drive point impedance, and relatively simple construction. Moreover, as compared with a dipole antenna, the monopole antenna is smaller in size and may be viewed as an asymmetric dipole antenna in which the monopole radiating element is one element and a radio case or the like is the other element. Because reduction in size is a desirable characteristic, certain monopole designs, such as the helical configuration disclosed in U.S. Pat. No. 5,231,412 to Eberhardt et al., have been utilized. By doing so, the physical length of the radiating element is significantly less than a corresponding straight wire radiator, but exhibits the same effective electrical length.

Nevertheless, reduction of physical size reduces the operating radiation bandwidth of an antenna due to changes in the input impedance over frequency. This reduction in bandwidth results from the combination of lower radiation resistance due to smaller antenna size and of a larger amount of stored energy, causing a high Q and low radiation bandwidth. In order to overcome this problem of reduction in operating radiation bandwidth, it has been found that a sleeve surrounding the monopole radiating element is able to extend the ground plane and therefore produce a virtual feedpoint at a designated location along the radiating element. This extension of the ground plane then has the effect of extending the radiation bandwidth, as seen in U.S. Pat. No. 5,231,412 and Japanese Patent 53-82246 to Takahashi.

Although helical radiating elements and corresponding sleeves therearound have been generally effective for their intended purpose, it has been difficult to manufacture such antennas within strict tolerance requirements. Moreover, even though such antennas have been able to reduce the physical length of such antennas, they have had the adverse effect of inherently increasing the diameters thereof. Accordingly, it would be desirable to develop a monopole antenna which is able to reduce the overall size thereof instead of just the physical length, as well as one which may be produced in a very precise fashion. Moreover, it would be desirable for such a monopole antenna to require a reactive element which is positioned only adjacent to one side of a portion of the radiating element, thereby eliminating the requirement for such reactive element to encircle the radiating element.

In light of the foregoing, a primary object of the present invention is to provide a monopole antenna having a configuration which increases the operating radiation bandwidth thereof.

Another object of the present invention is to provide a monopole antenna having a configuration which reduces the overall size thereof.

Yet another object of the present invention is to provide a monopole antenna with a conductive element which extends the ground plane, where the size of the reactive element is minimized.

A further object of the present invention is to provide a monopole antenna which can be constructed within very tight tolerances.

Another object of the present invention is to provide a monopole antenna having a virtual feedpoint from the end of a conductive element that defines an extended ground plane.

A further object of the present invention is to provide a printed monopole antenna constructed on a printed circuit board.

Still another object of the present invention is to provide a printed monopole antenna in which the radiating element is configured to have a physical length less than its electrical length.

Another object of the present invention is to provide a printed monopole antenna which is operable within two separate frequency bandwidths.

Yet another object of the present invention is to provide a printed monopole antenna which operates as a half-wavelength antenna at a frequency within a first frequency bandwidth and as a quarter-wavelength or half-wavelength antenna at a frequency within a second frequency bandwidth.

These objects and other features of the present invention will become more readily apparent upon reference to the following description when taken in conjunction with the following drawing.

SUMMARY OF THE INVENTION

In accordance with one aspect of the present invention, a printed monopole antenna is disclosed having a printed circuit board with a first side and a second side, a monopole radiating element comprising a first conductive trace formed on the printed circuit board first side, and a conductive element comprising a second conductive trace formed on the printed circuit board second side. The conductive element defines an extended ground plane which prevents the radiation of currents from that portion of the first conductive trace aligned with the second conductive trace.

In accordance with a second aspect of the present invention, a printed monopole antenna is disclosed having a printed circuit board with a first side and a second side, a monopole radiating element comprising a first conductive trace formed on one of the printed circuit board sides, and a conductive element comprising a second conductive trace formed on the same side of the printed circuit board as the first conductive trace. The second conductive trace may be formed on either or both sides of the first conductive trace to define an extended ground plane which prevents the radiation of currents from that portion of the first conductive trace aligned with the second conductive trace.

In accordance with a third aspect of the present invention, a third conductive trace is formed, either on an adjacent printed circuit board or adjacent to the first conductive trace on the printed circuit board first side, in order to permit the printed monopole antenna to operate within two separate frequency bandwidths. Alternatively, a parasitic element may be positioned on the printed circuit board second side at an end opposite the reactive element to permit dual frequency band operation of the printed monopole antenna.

BRIEF DESCRIPTION OF THE DRAWING

While the specification concludes with claims particularly pointing out and distinctly claiming the present invention, it is believed that the same will be better understood from the following description taken in conjunction with the accompanying drawing in which:

FIG. 1 is a schematic left side view of a printed monopole antenna in accordance with the present invention;

FIG. 2 is a schematic right side view of the printed monopole antenna depicted in FIG. 1;

FIG. 3 is an exploded schematic side view of the printed monopole antenna depicted in FIGS. 1 and 2;

DETAILED DESCRIPTION OF THE INVENTION

Figure 6:
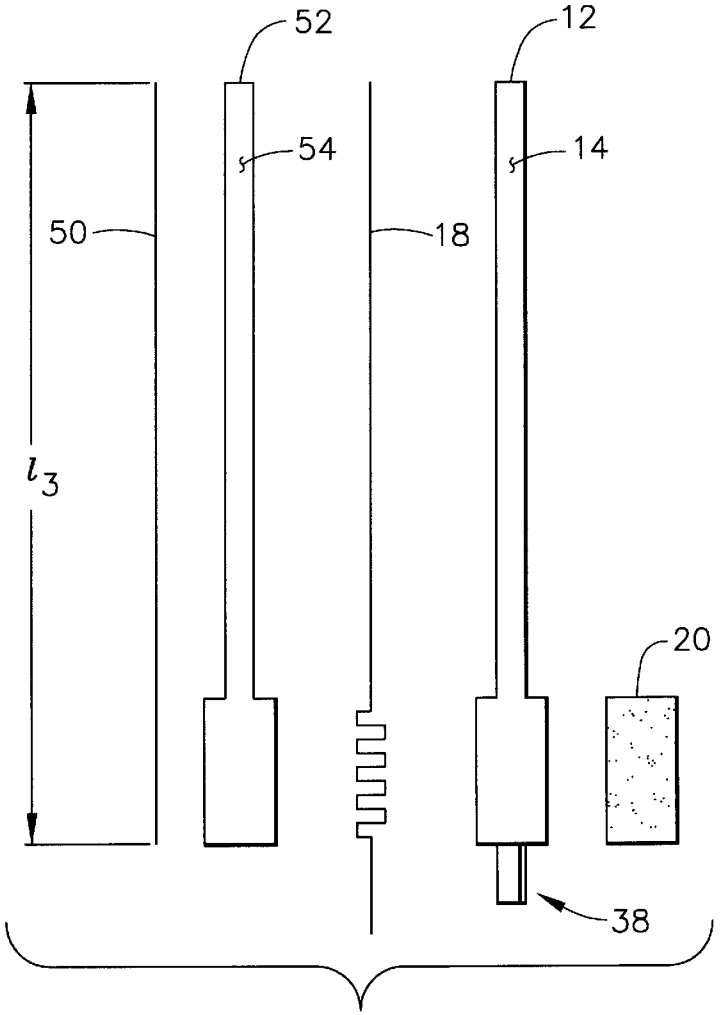
FIG. 6 is an exploded schematic side view of a printed monopole antenna operable within two separate frequency bandwidths, where the radiating element is two conductive traces formed on separate printed circuit boards.

Referring now to the drawings in detail, wherein identical numerals indicate the same elements throughout the figures, FIGS. 1–4 depict a printed monopole antenna 10 of the type utilized with radio transceivers, cellular telephones, and other personal communications equipment having a single frequency bandwidth of operation. As seen in FIGS. 1–3, printed monopole antenna 10 includes a printed circuit board 12, which preferably is planar in configuration having a first side 14 (FIG. 1) and a second side 16 (FIG. 2). It will be noted that printed monopole antenna 10 includes a monopole radiating element in the form of a first conductive trace 18 formed on first side 14 of printed circuit board 12. In addition, a conductive element in the form of a second conductive trace 20 is formed on second side 16 of printed circuit board 12. Second conductive trace 20 defines an extended ground plane 21 (denoted by a dashed line) which prevents the radiation of currents from printed monopole antenna 10 over that portion of first conductive trace 18 aligned with second conductive trace 20. In this way, a virtual feedpoint 22 is defined for printed monopole antenna 10 along extended ground plane 21.

More specifically, it will be seen that printed circuit board 12, which acts as a supporting surface, is preferably sized to accommodate first conductive trace 18. Accordingly, printed circuit board 12 includes a first rectangular section 24 adjacent a feed end 26 of antenna 10 and a second rectangular section 28 extending from first rectangular section 24 away from feed end 26. It will also be understood that printed circuit board 12 is made of a dielectric material, and optimally a flexible dielectric material in order to permit some degree of flexing or bending without breakage. Examples of flexible dielectric material which may be utilized include polyamide and polyester film from conductive materials (e.g., copper) and conductive inks.

With respect to the radiating element of printed monopole antenna 10, first conductive trace 18 is formed on first side 14 of printed circuit board 12 by film photo-imaging processes or other known techniques. Due to the equipment available for performing this task, adherence to strict size and design tolerances is permitted. First conductive trace 18 may be linear in configuration along printed circuit board 12, but it is preferred that at least a portion thereof be non-linear as identified generally by numeral 30. In this regard, first conductive trace 18 has a physical length $l_1$ with a feed end 32 and an opposite end 34. Feed end 32, which may be directly connected to the main control circuit for a radio transceiver, cellular telephone, or other communication device, preferably is coupled to a signal feed portion 36 of a feed port 38 (e.g., a coaxial connector).

As seen in FIGS. 1 and 3, non-linear portion 30 of first conductive trace 18 has a crank or square-wave type configuration. As such, non-linear portion 30 has what may be termed a duty cycle 40 defined as the distance between forward edges of adjacent cranks (see FIG. 3). While duty cycle 40 depicted in FIGS. 1 and 3 remains substantially constant, the actual distance between cranks, as well as the pattern utilized, may be modified according to the needs of a specific application. In this way, first conductive trace 18 may be configured to have an electrical length approximately equivalent to a quarter-wavelength or half-wavelength for a desired center frequency of antenna operation, as well as any other desired size. Further detail for the design of conductive traces is found in a patent application titled "Antenna Printed Having Electrical Length Greater Than Physical Length," Ser. No. 08/459,959, filed concurrently herewith, which is owned by the assignee of the present invention and hereby incorporated by reference.

With respect to second conductive trace 20 formed on second side 16 of printed circuit board 12, it will be noted that it has a physical length $l_2$ which extends from a grounding end 42 to an opposite end 44 (see FIG. 3). It will be understood that physical length $\mathbf{l_2}$ of second conductive trace 20 defines the distance in which the ground plane of printed monopole antenna 10 is extended. Therefore, it is at opposite end 44 thereof that extended ground plane 21 and virtual feedpoint 22 of printed monopole antenna 10 is located. It is a feature of the present invention that second conductive trace 20 acts to increase the bandwidth within which first conductive trace 18 will be resonant. For example, bandwidths of approximately an octive have been achieved (i.e., where the high end of the frequency band is approximately twice the low end of the frequency band). This is a marked improvement of bandwidths currently achieved ranging between 5–10% of the center frequency. Further, it will be recognized that the increased bandwidth need not be equally distributed higher and lower of the center frequency, such as when the antenna is sized near a half-wavelength of the center frequency.

Grounding end 42 of second conductive trace 20 is preferably coupled to a ground portion 46 of feed port 38. Accordingly, it will be noted that grounding end 42 of second conductive trace 20 is adjacent feed end 32 of first conductive trace 18. Second conductive trace 20 is shown as being formed entirely within first rectangular section 24 of printed circuit board second side 16 (although second conductive trace 20 could extend into second rectangular section 28 of printed circuit board 12), where it functions to prevent the radiation of currents from non-linear portion 30 of first conductive trace 18 aligned therewith. Although not shown, second conductive trace 20 could also be wrapped around the feed end of printed circuit board 12 and extend onto first side 14 thereof. Accordingly, due to the planar configuration of printed monopole antenna 10, the physical length of the radiating element (first conductive trace 18) is reduced, as well as the overall size of the conductive element (second conductive trace 20).

As is well known, the electrical length of an antenna's radiating element determines the center frequency of desired antenna operation. While the electrical length of first conductive trace 18 may be equivalent to physical length $l_1$ thereof when it has a linear configuration, it will be understood that the electrical length of first conductive trace 18 will be greater than physical length $l_1$ when it includes a non-linear portion such as that shown at 30. Preferably, first conductive trace 18 will have an electrical length which corresponds to either a quarter-wavelength or a half-wavelength for a desired center frequency. In order to provide an impedance match for broadband operation of printed monopole antenna 10, which generally is targeted at 50 ohms, the electrical length of second conductive trace 20 is sized accordingly with respect to the electrical length of first conductive trace 18.

Figure 4:
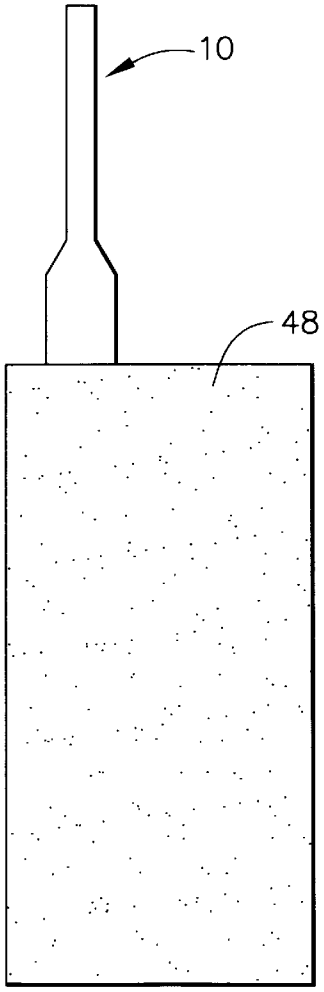
FIG. 4 is a schematic view of the printed monopole antenna depicted in FIGS. 1 and 2 mounted on a radio transceiver after it has been overmolded.

As seen in FIG. 4, printed monopole antenna 10 is coupled to a radio transceiver 48 such as by feed port 38. In order to protect printed monopole antenna 10 from environmental factors, as well as provide a more aesthetically pleasing appearance, it is preferred that printed monopole antenna 10 be overmolded by rubberizing the outside of printed monopole antenna 10 or otherwise coating it with molded material having a low dielectric loss. For further detail on the construction of printed monopole antenna 10, see a patent application entitled "Method Of Manufacturing A Printed Antenna," Ser. No. 08/460,578, filed concurrently herewith, which is also owned by the assignee of the present invention and hereby incorporated by reference.

Figure 5:
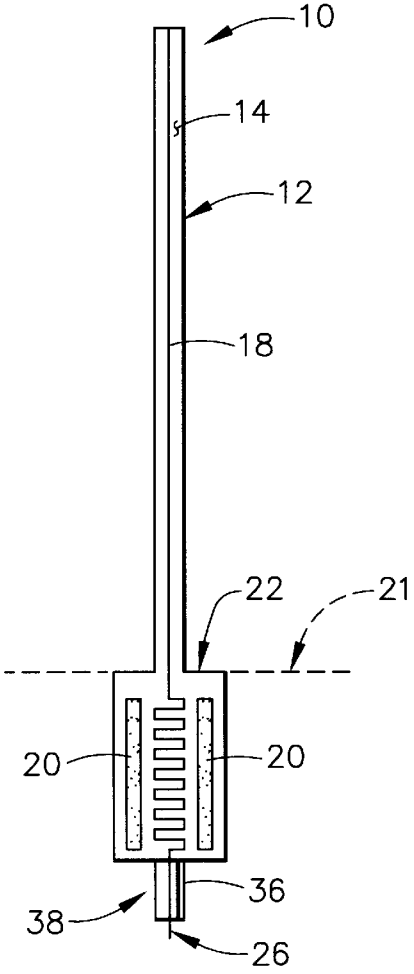
FIG. 5 is a schematic left side view of an alternative embodiment for the printed monopole antenna of the present invention.

As seen in FIG. 5, second conductive trace 20 may alternatively be formed on first side 14 of printed circuit board 12 adjacent first conductive trace 18. Second conductive trace 20 will function as described previously herein with respect to the embodiment depicted in FIGS. 1–3 to form extended ground plane 21 and virtual feed point 22 of printed monopole antenna 10. Although depicted as being positioned to each side of first conductive trace 18 in FIG. 5, it will be understood that second conductive trace 20 may be positioned to only one side thereof.

In order to permit printed monopole antenna 10 to operate within dual frequency bands, a second radiating element in the form of a third conductive trace 50 may be provided as described in more detail in a patent application entitled "Multiple Band Printed Monopole Antenna," Ser. No. 08/459,235 filed concurrently herewith, which is owned by the assignee of the present invention and hereby incorporated by reference. As will be seen in FIG. 6, third conductive trace 50 is formed on a side 54 of a second printed circuit board 52 opposite first conductive trace 18. Preferably, third conductive trace 50 has a physical length $l_3$ substantially equivalent to physical length $l_1$ of first conductive trace 18. However, it will be seen that third conductive trace 50 will have an electrical length less than that of first conductive trace 18 since it has an entirely linear configuration. In order to better separate the respective frequency bands radiated by first conductive trace 18 and third conductive trace 50, first conductive trace 18 may entirely have a non-linear configuration (e.g., the crank or square wave type disclosed herein), which provides a greater distinction in the respective electrical lengths of first and third conductive traces 18 and 50, respectively. In this regard, it may be preferred for first conductive trace 18, which will be resonant within a lower frequency band, to have an electrical length equivalent to a half-wavelength or a quarter-wavelength of a first desired center frequency and third conductive trace 50, which will be resonant within a higher frequency band, to have an electrical length equivalent to a half-wavelength of a second desired center frequency.

Figure 7:
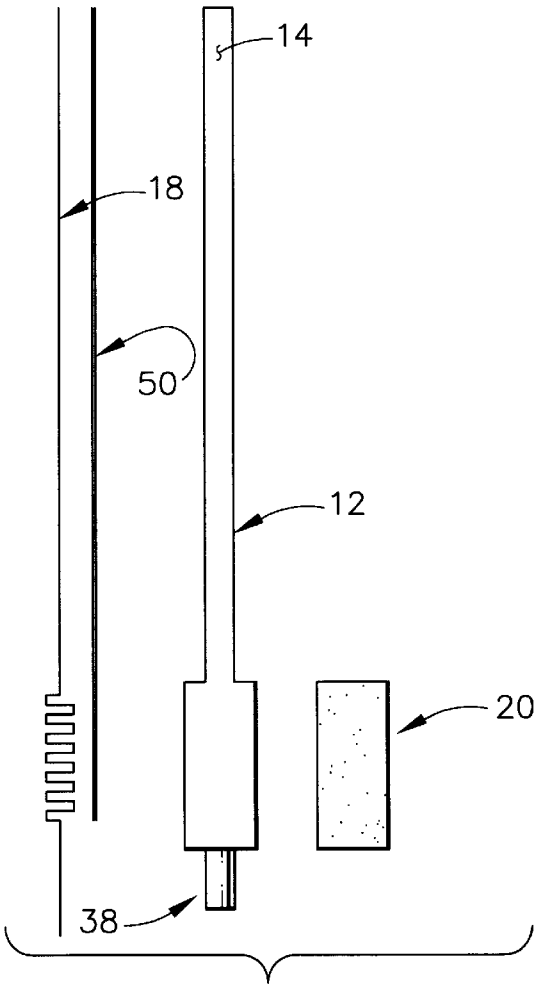
FIG. 7 is an exploded schematic side view of alternative configuration for a printed monopole antenna which is operable within two separate frequency bandwidths, where the radiating element is two conductive traces formed on the same side of a single printed circuit board.

It will be seen from FIGS. 6 and 7 that first conductive trace 18 behaves as the principle radiating element with a direct contact to a radio transceiver, cellular telephone, or other communication device. Second conductive trace 20, which performs the function of a conductive element, enhances the performance within both frequency bands radiated by first and third conductive traces 18 and 50. Since the presence of third conductive trace 50 has little effect on first conductive trace 18, an optimized response can be achieved for both frequency bands of operation.

An alternative configuration for printed monopole antenna 10 being operable over a dual frequency band is shown in FIG. 7 and described in more detail in the aforementioned patent application entitled "Multiple Band Printed Monopole Antenna" incorporated by reference. As seen therein, third conductive trace 50 is located adjacent first conductive trace 18 on first side 14 of printed circuit board 12. Other than being located on the same printed circuit board adjacent to first conductive trace 18, third conductive trace 50 has the same physical characteristics as that described above and functions in the same manner.

Figure 8:
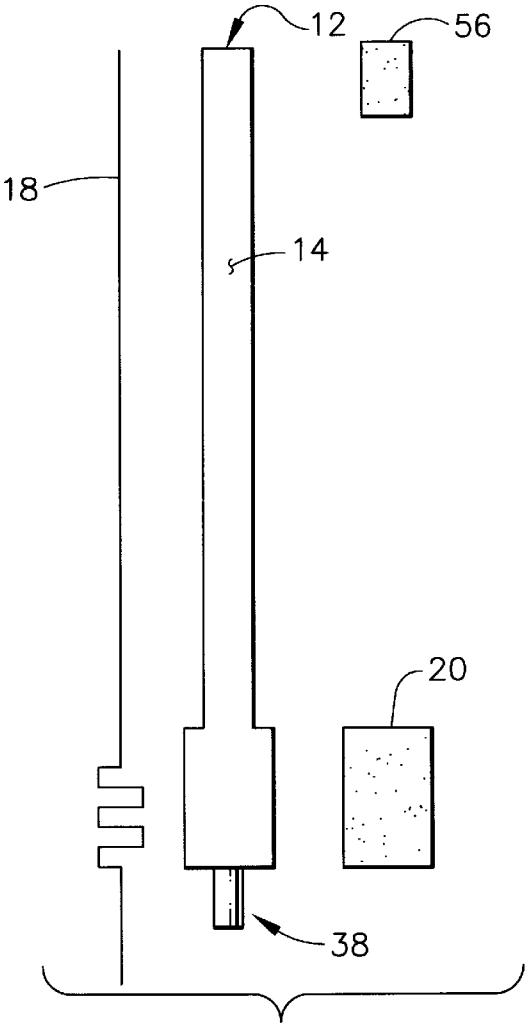
FIG. 8 is an exploded schematic side view of another alternative configuration for a printed monopole antenna operable within two separate frequency bandwidths, where the radiating element is a single conductive trace formed on one side of a printed circuit board which is tuned by a parasitic element on the opposite side of the printed circuit board.

A further alternative configuration for a printed monopole antenna 10 to be operated over two separate frequency bands is shown in FIG. 8 and described in detail in another patent application entitled "Multiple Band Printed Monopole Antenna," Ser. No. 08/459,553 filed concurrently herewith, which is also owned by the assignee of the present invention and hereby incorporated by reference. In this design, a parasitic element 56 is provided on second side 16 of printed circuit board 12 at an end opposite second conductive trace 20. Parasitic element 56, such as a copper strip, is used to tune the secondary resonance of first conductive trace 18 so that a second frequency band (other than an integer multiple of the frequency band radiated by first conductive trace 18 at primary resonance) is produced. It will be understood that the configuration of FIG. 8 employing parasitic element 56 is based on the same printed monopole antenna 10 described hereinabove, as is that shown with the configurations depicted in FIGS. 6 and 7.

Having shown and described the preferred embodiment of the present invention, further adaptations of the printed monopole antenna can be accomplished by appropriate modifications by one of ordinary skill in the art without departing from the scope of the invention.

What is claimed is:

1. A printed monopole antenna having a ground plane defined substantially perpendicular thereto, comprising:

(a) a first printed circuit board having a first side and a second side, said first printed circuit board lying in a plane substantially perpendicular to said ground plane;

(b) a monopole radiating element comprising a first conductive trace formed on said first printed circuit board first side, said first conductive trace having a physical length from a feed end to an opposite end; and (c) a conductive element comprising a second conductive trace formed on said printed circuit board adjacent said first conductive trace, said second conductive trace having a physical length from a grounding end to an opposite end; wherein said second conductive trace serves to extend said ground plane and prevents currents from radiating over that portion of said first conductive trace aligned with said second conductive trace, whereby said opposite end of said second conductive trace defines a virtual feedpoint for said first conductive trace.

2. The printed monopole antenna of claim 1, wherein said second conductive trace is formed on said printed circuit board second side.

3. The printed monopole antenna of claim 1, wherein said second conductive trace is formed on said printed circuit board first side.

4. The printed monopole antenna of claim 1, wherein said printed circuit board is made of a flexible dielectric material.

5. The printed monopole antenna of claim 1, wherein an electrical length of said first conductive trace defines a center frequency of antenna operation within a first frequency band.

6. The printed monopole antenna of claim 1, wherein said physical length of said second conductive trace determines the impedance match for broadband operation of said antenna.

7. The printed monopole antenna of claim 1, wherein said printed circuit board, said first conductive trace, and said second conductive trace are overmolded.

8. The printed monopole antenna of claim 1, wherein at least a portion of said first conductive trace is non-linear, whereby said physical length of said first conductive trace is less than an electrical length for said first conductive trace.

9. The printed monopole antenna of claim 8, said non-linear portion of said first conductive trace having a square wave configuration.

10. The printed monopole antenna of claim 1, further comprising a feed port including a signal feed portion and a ground portion, said signal feed portion being coupled to said feed end of said first conductive trace and said ground portion being coupled to said grounding end of said second conductive trace.

11. The printed monopole antenna of claim 10, wherein said feed port comprises a coaxial connector.

12. The printed monopole antenna of claim 1, wherein said monopole radiating element has an electrical length substantially equivalent to said physical length of said first conductive trace.

13. The printed monopole antenna of claim 1, wherein the physical length of said second conductive trace is less than the physical length of said first conductive trace.

14. The printed monopole antenna of claim 1, wherein an electrical length of said first conductive trace is approximately equivalent to a quarter-wavelength of a desired center frequency for antenna operation.

15. The printed monopole antenna of claim 1, wherein an electrical length of said first conductive trace is approximately equivalent to a half-wavelength of a desired center frequency for antenna operation.

16. The printed monopole antenna of claim 1, further comprising:

(a) a second printed circuit board having a first side and a second side, said second printed circuit board being oriented in a plane substantially parallel to and spaced from said first printed circuit board so that said first printed circuit board first side is adjacent said second printed circuit board second side; and (b) a third conductive trace formed on said second printed circuit board first side;

wherein said first conductive trace has an electrical length resonant within a first frequency band and said third conductive trace has an electrical length resonant within a second frequency band.

17. The printed monopole antenna of claim 1, further comprising a third conductive trace formed on said printed circuit board first side adjacent said first conductive trace, wherein said first conductive trace has an electrical length resonant within a first frequency band and said third conductive trace has an electrical length resonant within a second frequency band.

18. The printed monopole antenna of claim 1, further comprising a parasitic element formed on said printed circuit board second side, said parasitic element being located at said end opposite said second conductive trace, wherein said first conductive trace has an electrical length resonant within a first frequency band and said parasitic element tunes said first conductive trace to a secondary resonance within a second frequency band.

19. The printed monopole antenna of claim 1, said ground plane being defined by a housing of a portable communication device.

20. An antenna for a communication device, a housing for said communication device defining a ground plane, comprising:

(a) a feed port including a signal feed portion and a ground portion;

(b) a printed circuit board having a first side and a second side, said printed circuit board lying in a plane substantially perpendicular to said ground plane;

(c) a monopole radiating element comprising a first conductive trace formed on said printed circuit board first side, said first conductive trace having a physical length from a feed end coupled to said signal feed portion of said feed port to an opposite end; and (d) a conductive element comprising a second conductive trace formed on said printed circuit board adjacent said first conductive trace, said second conductive trace having a physical length from a grounding end coupled to said ground portion of said feed port to an opposite end, wherein said grounding end of said second conductive trace is located at the same end as said feed end of said first conductive trace;

wherein said second conductive trace extends said ground plane and prevents currents from radiating over that portion of said first conductive trace aligned with said second conductive trace, whereby said opposite end of said second conductive trace defines a virtual feedpoint for said first conductive trace.

21. The antenna of claim 20, wherein said second conductive trace is formed on said printed circuit board second side.

22. The antenna of claim 20, wherein said second conductive trace is formed on said printed circuit board first side.

23. The radio antenna of claim 20, wherein the physical length of said second conductive trace is sized to provide an impedance match with said first conductive trace.

24. The radio antenna of claim 20, wherein that portion of said first conductive trace aligned with said second conductive trace is non-linear.

* * * * *